US008371958B2

(12) United States Patent
Treadwell

(10) Patent No.: US 8,371,958 B2
(45) Date of Patent: Feb. 12, 2013

(54) GOLF CLUB FACE

(76) Inventor: Douglas Ames Treadwell, Grosse Ile, MI (US)

( * ) Notice: Subject to any disclaimer, the term of this patent is extended or adjusted under 35 U.S.C. 154(b) by 332 days.

(21) Appl. No.: 12/455,528

(22) Filed: Jun. 3, 2009

(65) Prior Publication Data

US 2010/0311519 A1 Dec. 9, 2010

(51) Int. Cl.
*A63B 53/04* (2006.01)

(52) U.S. Cl. ..... 473/331; 473/340

(58) Field of Classification Search ..... 473/331, 473/340

See application file for complete search history.

(56) References Cited

U.S. PATENT DOCUMENTS 5,637,044 A * 6/1997 Swash ..... 473/331
6,139,445 A 10/2000 Werner et al.
7,416,494 B2 8/2008 Edel
7,481,717 B2 1/2009 Knuth
7,494,424 B2 2/2009 Williams et al.
7,503,854 B2 3/2009 Galloway et al.
D591,814 S 5/2009 Bettinardi
2007/0093314 A1* 4/2007 Johnson ..... 473/340
2008/0125241 A1* 5/2008 Tateno et al. ..... 473/331
2010/0035703 A1* 2/2010 Ishikawa et al. ..... 473/340

* cited by examiner

*Primary Examiner* — Michael Dennis
(74) *Attorney, Agent, or Firm* — Mastrogiancomo PLLC

(57) ABSTRACT

A golf club head includes a heel, a toe, a level golf ball striking face extending from the heel to the toe and including a top edge and a bottom edge, and a patterned striking surface covering the level golf ball striking face extending to the heel, the toe, the top and the bottom edge. The patterned striking surface includes a plurality of generally pyramidal shaped extensions protruding from the level golf ball striking face, each of the pyramidal shaped extensions including a generally square base, four side walls and a top surface, each of the side walls extending outwardly a height H and at an angle Ω, the angle Ω being approximately equal to 60 degrees, from the golf ball striking face and the base, the center of the top surface of any pyramidal shaped extensions being separated from the centers of the top surfaces of all neighboring pyramidal shaped extensions by a width W.

8 Claims, 6 Drawing Sheets

GOLF CLUB FACE

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to golf clubs, and, more specifically to a golf club head having a face with a patterned surface that is used to strike a golf ball.

2. Background Art

The golf club has undergone numerous design iterations since the dawn of the game. The driver, fairway woods and irons have benefited from material improvements over the years, yet they have largely maintained their original geometries. Even a putter, a golf club that has been subjected to many different design iterations in hopes of engineering a putter that will make a difference between a birdie and a bogey, still maintains the same basic components for propelling a golf ball toward the hole. While the basic geometries of these golf clubs have stood the test of time, one component of the golf club has undergone numerous design changes, the striking surface or face on the head of the golf club.

The face of the golf club is the last component of the club to interact with a golf ball when the ball is struck by the club. Because the face is the part of the club to strike the golf ball, the face of the club can induce a number of different characteristics in the golf ball as it leaves the club face. For example, many golf club irons have a system of grooves that are etched or machined into the face of the club head. These grooves aid in displacing grass and water from around the golf ball as the club head strikes the golf ball. This helps to ensure that more of the face of the golf club will impact the ball to aid in making a more accurate and longer shot by the golfer. Similarly, the grooves found on golf club woods aid to induce a spinning motion in the golf ball as it leaves the ground to increase the height and distance of the golf ball.

Shorter irons or irons used for approach shots are not only used to propel the golf ball toward the green and ultimately the hole, they are used for with control and precision to land the golf ball as close to the hole as possible. Inducing a backspin in the golf ball with one of the shorter irons aids the golfer in controlling the golf ball and making a better shot toward the hole. While the traditional slotted grooves of the face do aid to induce some backspin on the golf ball, the typical amateur golfer finds that the amount of backspin required to improve their game is difficult to achieve and takes many years of practice.

The face of a traditional golf putter is typically flat without grooves or patterns of any type. One of the disadvantages of this type of putter face may be observed when a golf ball is struck. As with many other types of golf clubs, a typical putter with a flat face will tend to induce a backspin in the ball because a golfer will tend to strike the ball with the putter below the equator of the ball. The force of the putter will strike the lower portion of the ball thereby forcing a backspin in the ball. The force of the putter and the induced backspin will cause the ball to jump into the air and skid upon landing. As the ball skids across the ground the ball will begin to lose velocity. The skidding of the ball as well as the loss of velocity will cause the ball to deviate from the intended path to the target.

Therefore, a need exists for a golf club face having a patterned striking surface that will induce the desired spin in the golf ball as it is struck by the club.

BRIEF SUMMARY OF THE INVENTION

A golf club head is provided that includes a heel, a toe, a level golf ball striking face extending from the heel to the toe and including a top edge and a bottom edge, and a patterned striking surface covering the level golf ball striking face extending to the heel, the toe, the top edge and the bottom edge. The patterned striking surface includes a plurality of generally pyramidal shaped extensions protruding from the level golf ball striking face, each of the pyramidal shaped extensions including a generally square base, four side walls and a top surface, each of the side walls extending outwardly a height H and at an angle Ω, the angle Ω being approximately equal to 60 degrees, from the golf ball striking face and the base, the center of the top surface of any pyramidal shaped extensions being separated from the centers of the top surfaces of all neighboring pyramidal shaped extensions by a width W.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
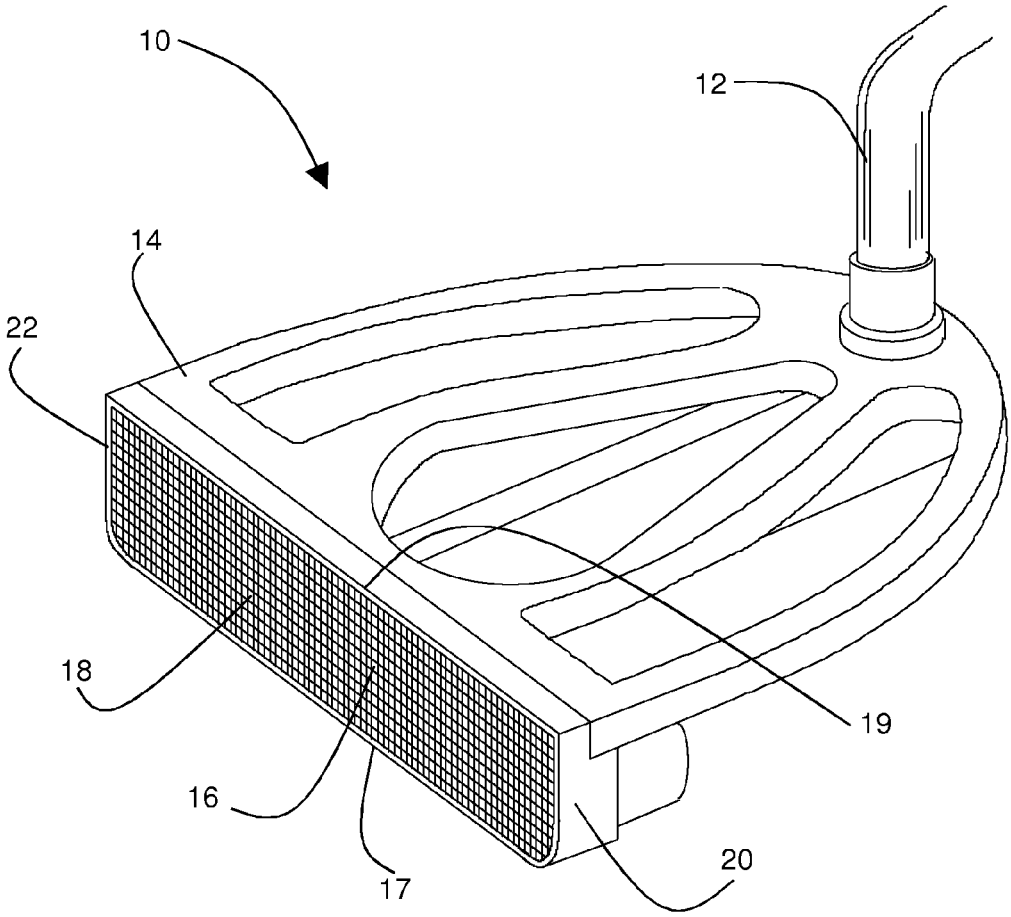
FIG. 1 is a perspective view of a putter head having a patterned golf ball striking surface according to an embodiment of the present invention.
Figure 2A:
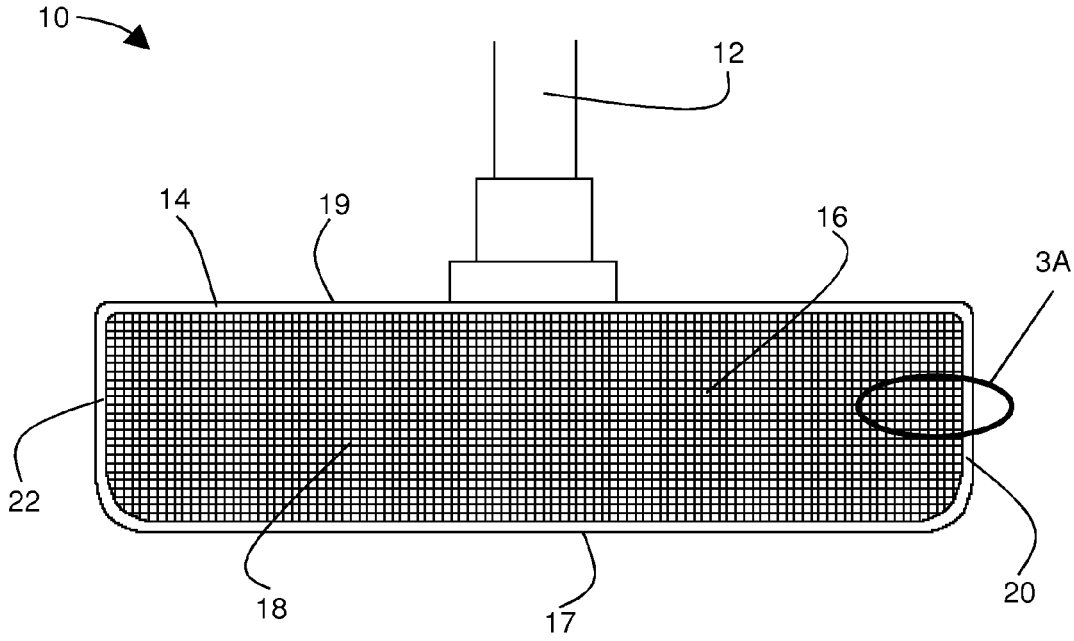
FIG. 2A is a front view of the patterned golf ball striking surface of the putter head according to an embodiment of the present invention.
Figure 2B:
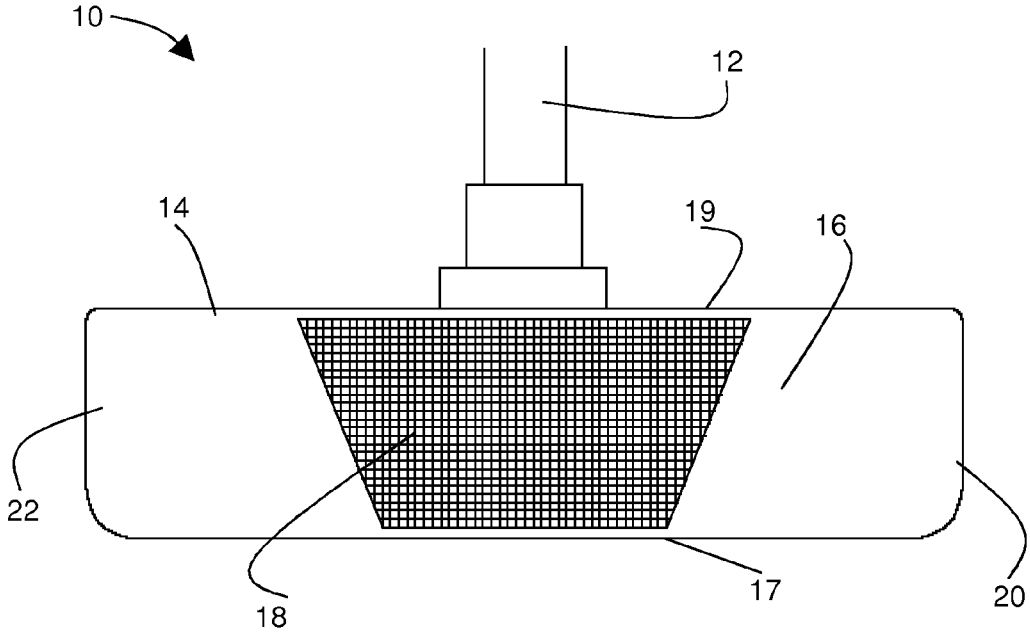
FIG. 2B is a front view of the patterned golf ball striking surface of the putter head according to another embodiment of the present invention.

Referring now to the drawings, several preferred illustrative embodiments of the present invention are shown in detail.

Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

A golf club is illustrated in FIG. 1 according to an embodiment of the present invention. In this particular embodiment of the present invention, the golf club is a putter 10. Putter 10 includes a putter head 14 and a shaft 12 that is secured to and extends from head 14. Head 14 includes a ball striking surface or face 16 that is used to strike a golf ball. Shaft 12 may include a grip (not shown) that may be attached at an end of shaft 12 that is opposite the end of the shaft that is secured at head 14. An individual attempting a golf shot with the putter will generally hold putter 10 at the grip and position themselves to address the golf ball. Typically, shaft 12 extends a length from head 14 that will allow an individual to induce a swinging motion in putter 10 allowing them to strike a golf ball with face 16 of putter head 14 (see e.g. FIG. 5A).

Figure 3A:
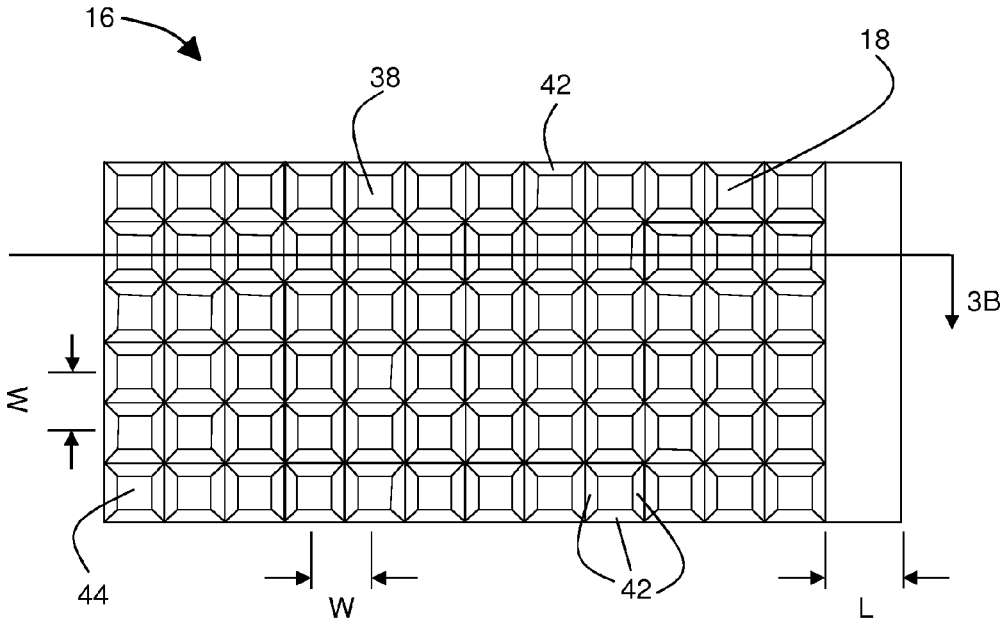
FIG. 3A is an enlarged view of the patterned golf ball striking surface of the putter head illustrated in FIG. 2A according to an embodiment of the present invention.
Figure 3B:
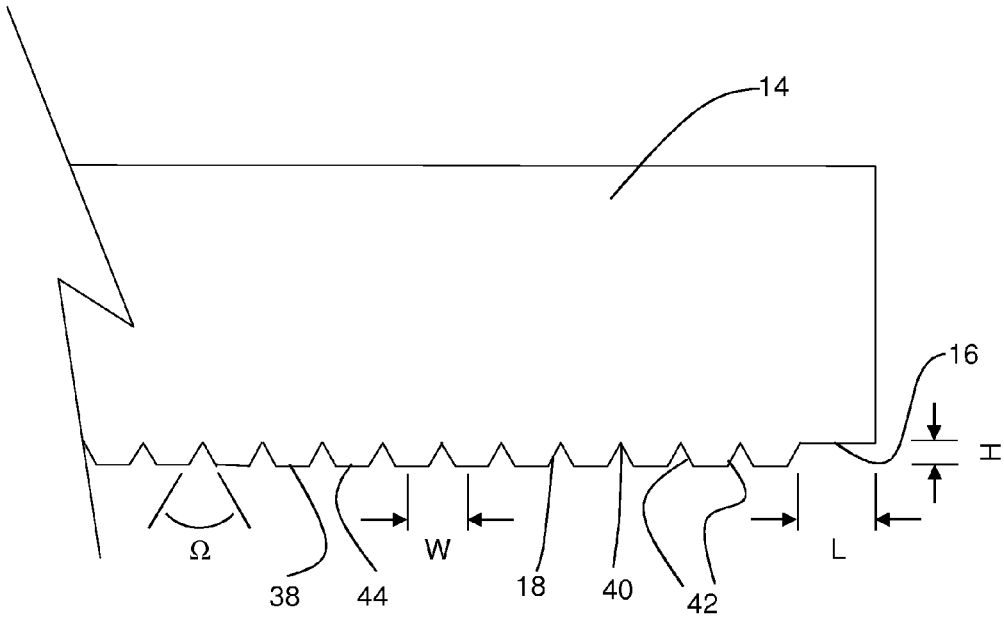
FIG. 3B is a cross-sectional top view of the patterned golf ball striking surface of the putter head illustrated in FIG. 3A according to an embodiment of the present invention.

Referring now to FIGS. 1-3B, ball striking surface or face 16 will be described in greater detail. Generally, the striking face of many prior art putters are flat or level and include grooves or recesses that are cut into the face. In an embodiment of the present invention, face 16 is level and includes a patterned striking surface or pattern 18 that protrudes outward from face 16 (See e. g. FIG. 3B). Pattern 18 may extend from a bottom edge 17 to a top edge 19 of face 16 and from the side at a heel 20 to the side at a toe 22. Heel 20 and toe 22 are designations provided to golf clubs and are well known in the art. Typically, heel 20 is the portion of the golf club that is closest to the golfer when the golfer is properly addressing and preparing to strike a golf ball. Toe 22 is the portion of the golf club that is furthest from the golfer. Although, pattern 18 is described as covering the majority of face 16, it is important to note, however, that pattern 18 may cover only a portion of face 16, as shown in FIG. 2B, and perform equally as well. Pattern 18 may be configured in any design on face 16, such as, for example, a square, circle, triangle, etc. (FIG. 2B illustrates a trapezoid).

Pattern 18 may be machined onto face 16 with any typical computer numerical controlled (CNC) machine. Alternatively, pattern 18 may be stamped or pressed into face 16. Pattern 18 may also be manufactured separately from putter 10 and attached to face 16 with an adhesive or fasteners. The above pattern manufacturing means are examples of many methods that may be used to create pattern 18 on face 16. Irregardless of the method used to impart pattern 18 onto face 16, the end result will be the same, namely to induce the desired spin characteristics into the golf ball upon contact with pattern 18 of face 16.

In this particular embodiment of the present invention, pattern 18 may be machined directly into face 16. FIGS. 3A and 3B illustrate a particular pattern that may be machined into face 16. In this particular embodiment of the present invention, patterned striking surface 18 is comprised of a number of pyramidal shaped extensions 44 that protrude outward from face 16. Each pyramidal shaped extension 44 is comprised of a generally square base 40, four walls 42 and a generally flat top surface 38. It is important to note that surface 38 may be rounded, pointed, etc. to achieve the desired spin characteristics in the golf ball. Each of four walls 42 of each pyramidal shape extend generally outward from base 40 and face 16 by a height H and at an angle Ω as shown in FIG. 3B. The distance between the centers of top surface 38 of each pyramidal shape 44 is denoted by W. A boarder denoted by L in FIGS. 3A and 3B may also be included around the perimeter of face 16. In this particular embodiment of the present invention, H is approximately equal to 0.019 inches, W is approximately equal to 0.050 inches, L is approximately equal to 0.0625 inches and Ω is approximately equal to 60 degrees. It is important to note that this particular pattern with these particular dimensions has been approved for use by all golfers for use in professional golf tournaments by the United States Golf Association (USGA), the governing body for the rules of golf in the United States. While this pattern with these particular dimensions has been approved for use by the USGA, it is also important to note that pattern 18 may be manufactured with a change to any and all of the above dimensions and may be used on any golf club to induce the desired spin characteristics in the golf ball.

Figure 3C:
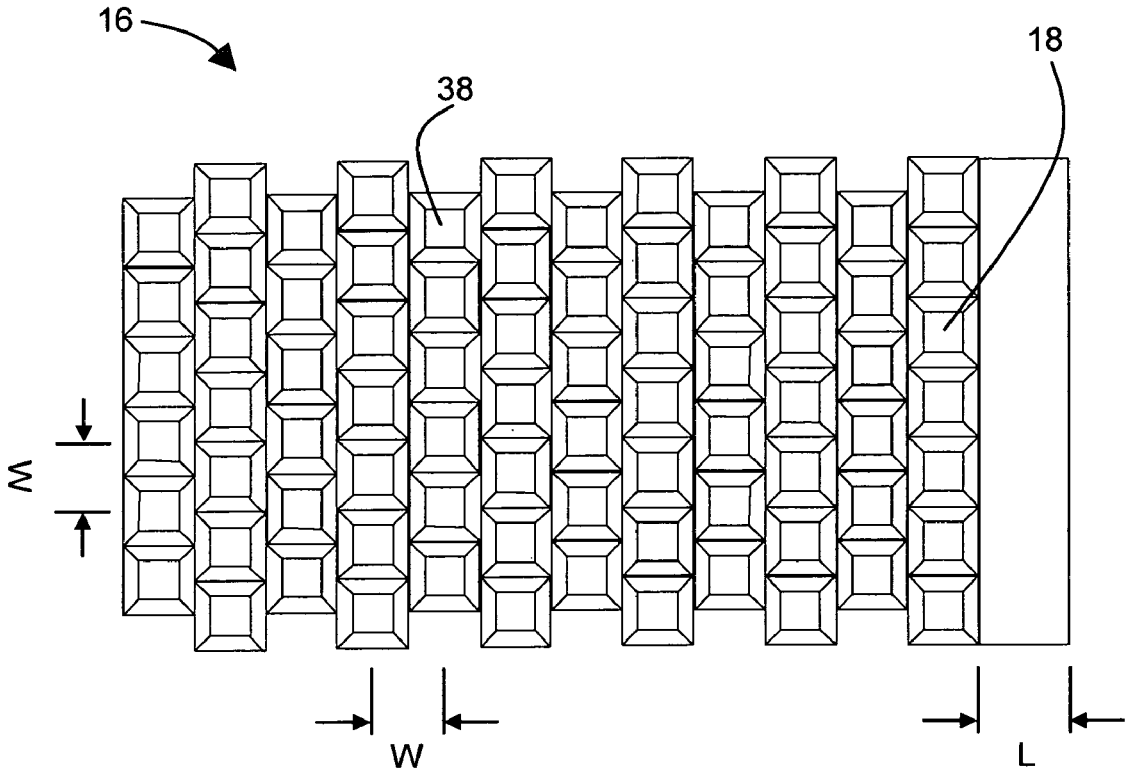
FIG. 3C is an enlarged view of the patterned golf ball striking surface of a putter head according to another embodiment of the present invention.

Now referring to FIG. 3C, pattern 18 is illustrated according to another embodiment of the present invention. In this particular embodiment, the pyramidal shapes are offset from one another. Offsetting the pyramidal shapes provides another means for creating a pattern that may be added to the ball striking surface of a golf club so that the desired spin may be induced in the golf ball as it is struck by the face of the golf club head. Although two pattern examples have been illustrated, it is important to note that the pyramidal shapes may be positioned and attached in any manner upon the ball striking surface of the golf club head to achieve the desired spin characteristics in a golf ball when the golf ball is struck by the face of the golf club head.

Figure 5A:
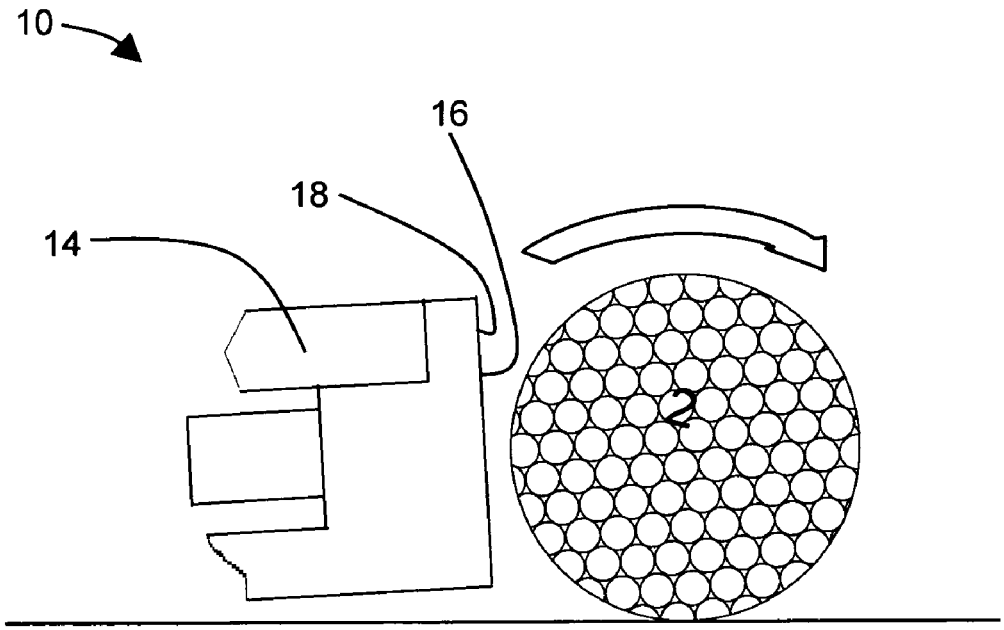
FIG. 5A is a side view of the putter shown inducing a topspin in a golf ball according to an embodiment of the present invention.

Generally, putters are one club of many that are used to play golf on a typical golf course. Usually putters are used on or slightly off the green as a means of propelling a golf ball toward a hole. The face of the putter is used to strike the golf ball as the individual swings the shaft and the putter head into the ball. As described above, patterned striking surface 18 may be fashioned across face 16 of the putter. Including pattern 18 on face 16 will aid putter 10 in inducing a topspin in the golf ball. When pattern 18 of face 16 contacts the ball, as putter 10 is swung through the bottom arc of a typical putting motion and into an upswing, the increased friction of pattern 18 (over a typical semi-smooth surface) will grab the surface of the ball and rotate the ball in a forward motion away from the putter face thereby inducing a topspin and propelling the ball toward the hole or target as illustrated by FIG. 5A. The topspin will create a gyroscopic effect in the golf ball causing the ball to travel a shorter distance in the air after first being struck by putter 10, reduce the amount of skid the golf ball may otherwise undergo if backspin were induced in the golf ball by a typical smooth or semi-smooth faced putter and maintain a straighter path toward the target or hole. The topspin that has been induced in the golf ball is important to maintain the ball on the intended path toward the hole or target. As stated above, any type of backspin induced by a putter may cause the ball to skid across the grass surface or green which in turn may cause the golf ball to deviate from its intended course.

Figure 4:
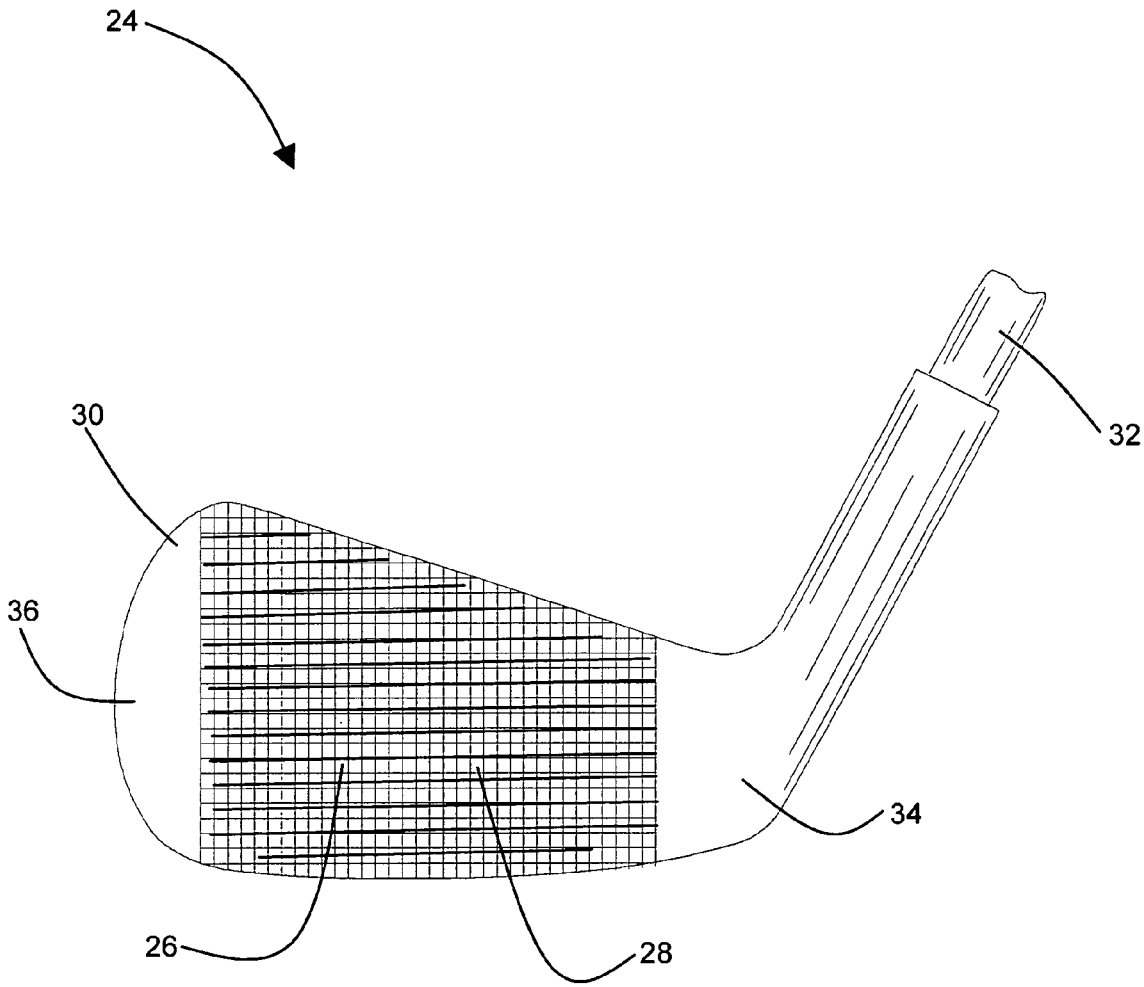
FIG. 4 is a front view of a patterned golf ball striking surface of an iron according to another embodiment of the present invention.

FIG. 4 illustrates another type of golf club, an iron 24, which also includes a ball striking surface or face 26 having a similar patterned striking surface or pattern 28 to that of putter 10 above according to another embodiment of the present invention. Iron 24 includes a head 30 and a shaft 32 that is secured to and extends from head 30. Head 30 includes face 26 that is used to strike a golf ball. Shaft 32 may include a grip (not shown) that may be attached at an end of shaft 32 that is opposite the end of the shaft that is secured at head 30. An individual attempting a golf shot with the iron will generally hold iron 24 at the grip and position themselves to address the golf ball. Typically, shaft 32 extends a length from head 30 that will allow an individual to induce a swinging motion in iron 24 allowing them to strike a golf ball with face 26 of head 30 (see e.g. FIG. 5B).

While an individual may induce a swinging motion in both putter 10 and iron 24 to propel the golf ball, typically, the swinging motions may be very different. When a golfer uses a putter, a more precise swinging motion may be induced to more accurately control the speed and direction of the golf ball toward the hole. On the other hand, when a golfer uses an iron to propel the golf ball, typically the golfer is playing a shot from a much longer distance to the intended target and will create a larger swinging motion in the iron to propel the ball the further distance.

As described above for putter 10, pattern 28 may extend from the bottom to the top of face 26 and from a side at a heel 34 to a side at toe 36. As mentioned above, heel 34 and toe 36 are designations provided to golf clubs and are well known in the art. Typically, with irons, pattern 28 may not extend fully into heel 34 and toe 36 as shown in FIG. 4. As with putters, pattern 28 may be configured in any design on face 26, such as, for example, a square, circle, triangle, etc.

Irons may have pattern 28 added to face 26 in much the same manners as described above for putters. Pattern 28 may be machined onto face 26 with any typical computer numerical controlled (CNC) machine. Alternatively, pattern 28 may be stamped or pressed into face 26. Pattern 28 may also be manufactured separately from iron 24 and attached to face 26 with an adhesive or fasteners. The above pattern manufacturing means are examples of many methods that may be used to create pattern 28 on face 26. Irregardless of the method used to impart pattern 28 onto face 26, the end result will be the same, namely to induce the desired spin characteristics into the golf ball upon contact with pattern 28 of face 26.

In this particular embodiment of the present invention, pattern 28 may once again be machined directly into face 26. As stated above, FIGS. 3A and 3C illustrate examples of patterns that may also be machined into face 26. Pattern 28 may be the same as pattern 18 and is comprised of a number of pyramidal shaped extensions having a generally flat top surface 38 that protrude from face 26. Each pyramidal shape extends generally outward from face 26 by H as shown in FIG. 3B. The distance between the centers of each pyramidal shape is denoted by W and each pyramidal shape is generally separated by an angle Ω. In this particular embodiment of the present invention, H is approximately equal to 0.019", W is approximately equal to 0.050" and Ω is approximately equal to 60 degrees. It is important to note that pattern 28 may be manufactured with a change to any and all of the above dimensions and may be used on any golf club to induce the desired spin characteristics in the golf ball.

Figure 5B:
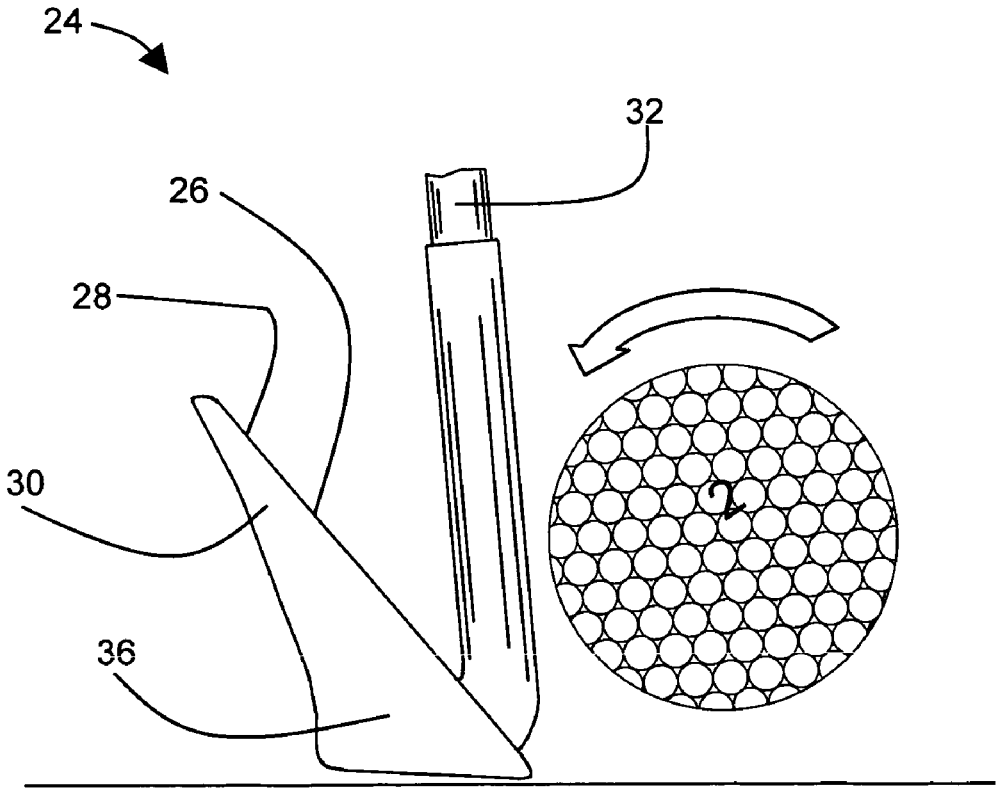
FIG. 5B is a side view of the iron shown inducing a backspin in a golf ball according to an embodiment of the present invention.

Generally, irons are one club of many that are used to play golf on a typical golf course. Irons may be widely used on the golf course to propel a golf ball to an intended target. Irons may be used to tee off to begin a hole, to play second or third shots at a target or chipping near the green or hole. The face of the iron is used to strike the golf ball as the individual swings the shaft and the iron head into the ball. Including patterned striking surface 28 on face 26 will aid iron 24 in producing backspin in the golf ball. When pattern 28 of face 26 contacts the ball, as iron 24 is swung through the bottom arc of a typical swinging motion and into an upswing, the increased friction of pattern 28 (over a typical semi-smooth grooved surface) will grab the surface of the ball and rotate the ball in a rearward motion as the iron is swept under the ball thereby inducing a backspin as the ball is propelled toward the target as illustrated by FIG. 5B. The backspin will create a gyroscopic effect in the golf ball causing the ball to backup or reverse its direction upon landing. Ideally, the golfer will aim the ball so that it lands beyond the intended target and the backspin that has been induced in the ball will aid in guiding the ball back to the target. Any type of topspin induced by an iron may cause the ball to skip and skid across the grass surface or green which in turn may cause the golf ball to deviate from its intended course.

Although patterns 18 and 28 have been described above with putter 10 and iron 24, it is important to note that these patterns may be added to the ball striking surfaces or faces of any type of golf clubs such as drivers, fairway woods, hybrids as well as others. A golf club will induce a spin in a golf ball as the face of the club strikes the ball. Often the spin induced in the golf ball is unintended and may lead to a poor golf shot. The embodiments of the present invention described above will aid the golfer to induce an intended spin in the golf ball in an effort to improve their overall game.

The present invention has been particularly shown and described with reference to the foregoing embodiments, which is merely illustrative of the best modes presently known for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method within the scope of these claims and their equivalents by covered thereby. This description of the invention should be understood to include all novel and non-obvious combination of elements described herein, and claims may be presented in this or a later application to any novel non-obvious combination of these elements. Moreover, the foregoing embodiments are illustrative, and no single feature or element is essential to all possible combinations that may be claimed in this or a later application.

What is claimed is:

1. A golf club head comprising; a heel: a toe; a level golf ball striking face, said golf ball striking face extending from said heel to said toe and including a top edge and a bottom edge; a patterned striking surface covering said level golf ball striking face extending to said heel, said toe, said top edge and said bottom edge; and a plurality of generally pyramidal shaped extensions protruding from said level golf ball striking face, said patterned striking surface being comprised of said pyramidal shaped extensions, each of said pyramidal shaped extensions including a generally square base, four side walls and a top surface, each of said side walls extending outwardly a height H and at an angle Ω said angle Ω being approximately equal to 60 degrees, from said golf ball striking face and said base, the center of said top surface of any said pyramidal shaped extensions being separated from the centers of said top surfaces of all neighboring said pyramidal shaped extensions by a width W; wherein said height H is approximately equal to 0.019 inches; and wherein said width W is approximately equal to 0.050 inches.

2. The golf club head as recited in claim 1, wherein said top surface is generally flat.

3. The golf club head as recited in claim 1, wherein said pyramidal shapes are positioned adjacent one another in aligned rows and columns.

4. The golf club head as recited in claim 1, wherein said golf club head is a putter head.

5. A patterned striking surface for a level golf ball striking face of a golf club comprising:

a plurality of generally pyramidal shaped extensions protruding from said level golf ball striking face, each of said pyramidal shaped extensions including a generally square base, four side walls and a top surface, each of said side walls extending outwardly a height 0.019 inches and at an angle of 60 degrees from said golf ball striking face and said base, the center of said top surface of any said pyramidal shaped extensions being separated from the centers of said top surfaces of all neighboring said pyramidal shaped extensions by 0.050 inches.

6. The golf club head as recited in claim 5, wherein said top surface is generally flat.

7. The golf club head as recited in claim 5, wherein said golf club is a putter.

8. A putter having a patterned golf ball striking surface comprising:

a plurality of generally pyramidal shaped extensions protruding from a level golf ball striking face, each of said pyramidal shaped extensions including a generally square base, four side walls and a top surface, each of said side walls extending outwardly a height 0.019 inches and at an angle of 60 degrees from said golf ball striking face and said base, the center of said top surface of any said pyramidal shaped extensions being separated from the centers of said top surfaces of all neighboring said pyramidal shaped extensions by 0.050 inches.

* * * * *